US010116078B1

(12) United States Patent
Durse et al.

(10) Patent No.: US 10,116,078 B1
(45) Date of Patent: Oct. 30, 2018

(54) HIGH CURRENT COMPRESSION BLADE CONNECTION SYSTEM

(71) Applicant: Delphi Technologies, Inc., Troy, MI (US)

(72) Inventors: Nicholas A. Durse, Youngstown, OH (US); Terry A. George, Salem, OH (US); Adam Wolfgang, Petersburg, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/724,654

(22) Filed: Oct. 4, 2017

Related U.S. Application Data

(60) Provisional application No. 62/539,656, filed on Aug. 1, 2017.

(51) Int. Cl.

| | |
|---|---|
| ***H01R 13/627*** | (2006.01) |
| ***H01R 13/193*** | (2006.01) |
| ***H01R 13/621*** | (2006.01) |
| ***H01R 13/26*** | (2006.01) |
| ***H01R 13/207*** | (2006.01) |
| *H01R 13/44* | (2006.01) |

(52) U.S. Cl.
CPC ..... *H01R 13/193* (2013.01); *H01R 13/207* (2013.01); *H01R 13/26* (2013.01); *H01R 13/6215* (2013.01); *H01R 13/44* (2013.01)

(58) Field of Classification Search
CPC .... H01R 13/193; H01R 13/26; H01R 13/207; H01R 13/6215; H01R 13/44
USPC ..... 439/362, 364
See application file for complete search history.

(56) References Cited

U.S. PATENT DOCUMENTS

| | | | | |
|---|---|---|---|---|
| 5,829,999 | A * | 11/1998 | Macleod | H01R 13/207 439/346 |
| 6,692,316 | B2 | 2/2004 | Hsieh et al. | |
| 6,945,826 | B2 | 9/2005 | Wise | |
| 8,298,022 | B2 | 10/2012 | Tsuruta et al. | |
| 9,647,372 | B2 | 5/2017 | Eckel | |
| 9,847,603 | B1 * | 12/2017 | Vo | H01R 13/652 |
| 2016/0064849 | A1 | 3/2016 | Eckel | |
| 2016/0372883 | A1 * | 12/2016 | Liu | H01R 43/26 |

* cited by examiner

*Primary Examiner* — Khiem Nguyen
(74) *Attorney, Agent, or Firm* — Robert J. Myers

(57) ABSTRACT

An electrical terminal connection system includes a first-housing and a second-housing. The first-housing has a first-electrical-terminal and a terminal-hood. The first-electrical-terminal has a first-planar-section having a rectangular cross-section. The terminal-hood encapsulates an inner-surface and edges of the first-electrical-terminal. The second-housing is configured to mate with the first-housing and has a second-electrical-terminal and a sliding-block. The second-electrical-terminal has a second-planar-section having a rectangular cross-section and overlays an outer-surface of the first-electrical-terminal. The second-housing includes a first-fastener element operable to engage a second-fastener element disposed within the first-housing. The second-housing is drawn into the first-housing when the first-fastener element and the second-fastener element are joined. The sliding-block imparts a lateral-force on the terminal-hood and urges the first-planar-section into electrical-contact with the second-planar-section.

15 Claims, 5 Drawing Sheets

HIGH CURRENT COMPRESSION BLADE CONNECTION SYSTEM

CROSS-REFERENCE TO RELATED APPLICATION

This application claims the benefit under 35 U.S.C. § 119(e) of U.S. Provisional Patent Application No. 62/539,656, filed Aug. 1, 2017, the entire disclosure of which is hereby incorporated herein by reference.

TECHNICAL FIELD OF INVENTION

This disclosure generally relates to an electrical connector, and more particularly relates to an electrical connector that is capable of transferring electrical current in excess of 200 Amperes.

BACKGROUND OF INVENTION

It is known to use electrical connectors capable of transferring electrical current in excess of 100 Amperes (100 A) in electric vehicles (EVs) hybrid-electric vehicles (HEVs). As non-EVs and non-HEVs become increasingly electrified to reduce greenhouse gasses, electrical connectors require increasingly robust, reliable, and safe designs.

High current electrical connectors have used ring terminals and bolts to increase a clamp force between electrical terminals. These ring and bolt connector designs typically require large mounting areas. Increasing the current carrying capacity of these connector designs is typically accomplished by increasing a diameter of the ring terminal to provide a larger contact area, making the resulting connector systems more difficult to package within a vehicle. Blade and socket terminal connectors can be configured to be more compact, however increased clamp force typically requires increased insertion force which may exceed ergonomic force limits for assembly operators. Therefore a compact connector system capable of providing adequate clamp force for high current applications while also capable of meeting ergonomic mating force requirements for assembly operators remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

Described herein is a connector system that may produce a clamping force equivalent to a ring terminal connector without the limitations of the ring terminal geometry. The connector uses symmetrical blade geometries and reduces the complexity of the connection system compared to previous connection systems that require unique male and female terminals.

An electrical terminal connection system includes a first-housing and a second-housing. The first-housing has a first-electrical-terminal and a terminal-hood. The first-electrical-terminal has a first-planar-section having a rectangular cross-section. The terminal-hood encapsulates an inner-surface and edges of the first-electrical-terminal. The second-housing is configured to mate with the first-housing and has a second-electrical-terminal and a sliding-block. The second-electrical-terminal has a second-planar-section having a rectangular cross-section and overlays an outer-surface of the first-electrical-terminal. The second-housing includes a first-fastener element operable to engage a second-fastener element disposed within the first-housing. The second-housing is drawn into the first-housing when the first-fastener element and the second-fastener element are joined. The sliding-block imparts a lateral-force on the terminal-hood and urges the first-planar-section into electrical-contact with the second-planar-section.

The second-housing includes a retainer-clip configured to inhibit a lateral-deflection of the second-housing when the sliding-block imparts the lateral-force. The terminal-hood is composed of a dielectric material. An extension of the first-electrical-terminal projects beyond a base of the first-housing. The terminal-hood further defines an aperture, wherein the extension is disposed within the aperture and prevents a movement of the terminal-hood. The terminal-hood includes a ramp that engages the sliding-block. The second-housing includes a blade-pocket that encapsulates an outer-surface of the second-electrical-terminal and encapsulates edges of the second-electrical-terminal.

The lateral-force is at least 30 Newtons. The first-electrical-terminal and the second-electrical-terminal are orientated perpendicularly to one another. The sliding-block is characterized as having a wedge-shape or a conical-shape. The first-housing includes a plurality of first-electrical-terminals and the second-housing includes a plurality of second-electrical-terminals. The plurality of first-electrical-terminals and the plurality of second-electrical-terminals are positioned proximate to at least two opposing sides of the sliding-block. The plurality of first-electrical-terminals and the plurality of second-electrical-terminals are positioned on one side of the sliding-block.

The first-fastener element further includes a flange and a shank and the sliding-block defines a guide-hole and a shoulder. The shank is positioned within the guide-hole and the flange is in contact with the shoulder. The sliding-block defines a shoulder-projection that engages the second-housing when the first-fastener element and the second-fastener element are joined.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

The connector system presented herein utilizes several novel features. The connector system is configured to provide clamping forces similar to those of bolted ring terminals by using a wedge and spring clip combination to apply the clamping forces to the mated terminals thus allowing higher current and voltage capabilities than on existing non-bolted ring terminals.

FIGS. 1A-1D illustrate four views of a non-limiting example of an electrical terminal connection system 10, hereafter referred to as the connection system 10. As will be described in more detail below, the connection system 10 is an improvement over previous connection systems, because the connection system 10 is capable of generating high clamp forces needed to enable high electrical current connections.

Figure 1B:
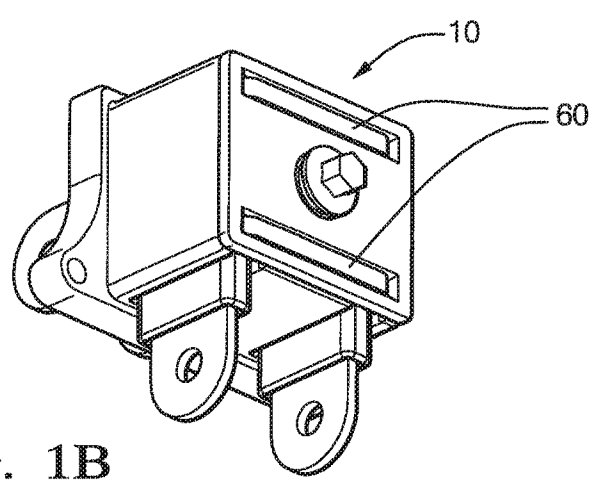
FIG. 1B is an illustration of a perspective-view of the electrical terminal connection system of FIG. 1A in accordance with one embodiment.
Figure 1D:
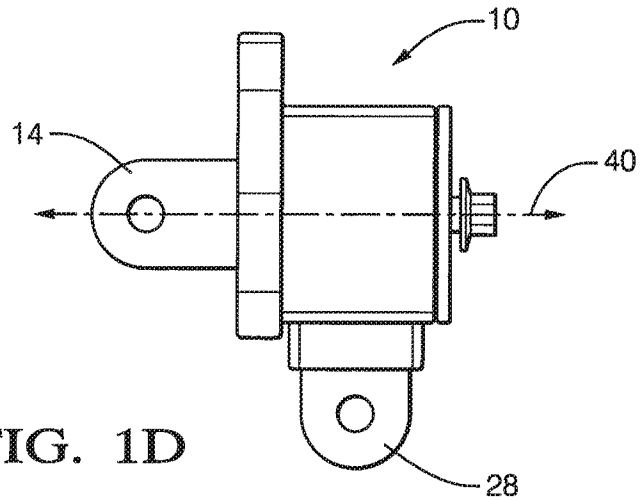
FIG. 1D is an illustration of a side-view of the electrical terminal connection system of FIG. 1A in accordance with one embodiment.
Figure 1A:
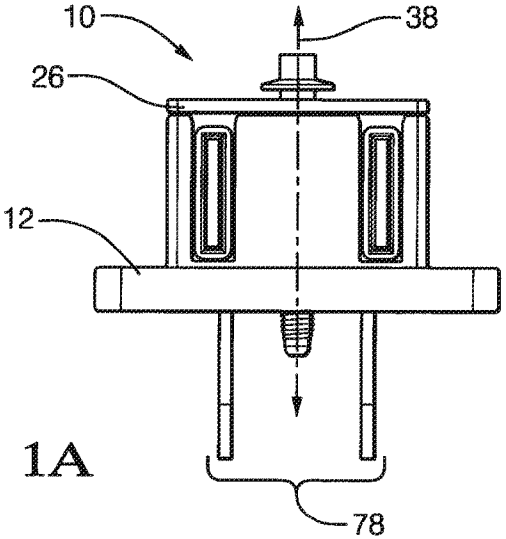
FIG. 1A is an illustration of an end-view of an electrical terminal connection system in accordance with one embodiment.
Figure 1C:
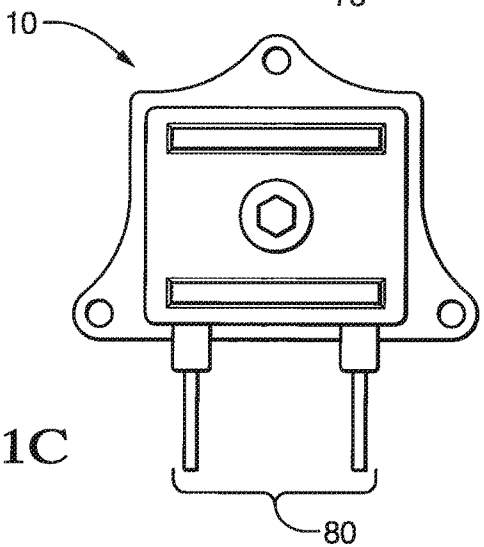
FIG. 1C is an illustration of top-view of the electrical terminal connection system of FIG. 1A in accordance with one embodiment.
Figure 2:
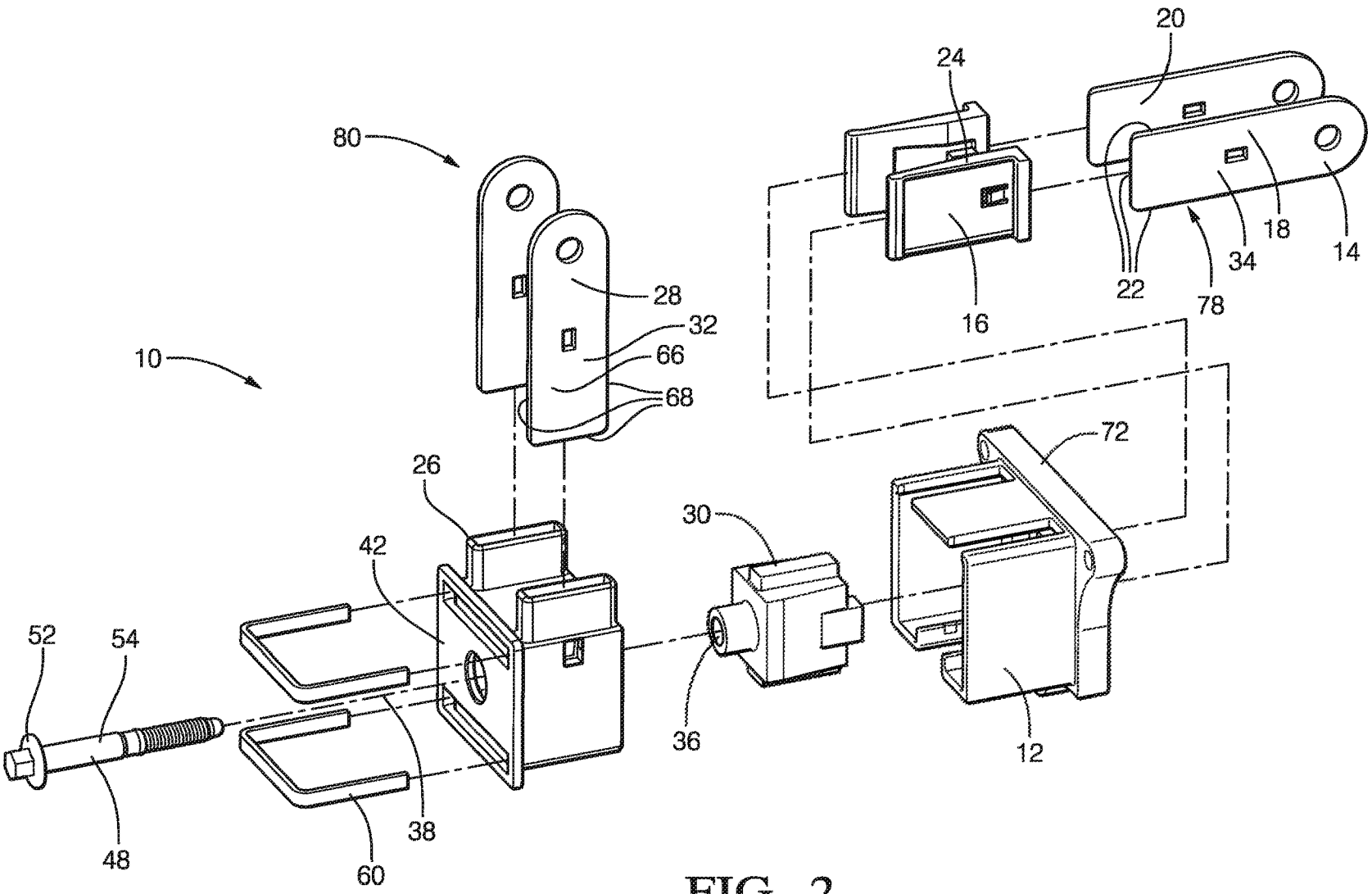
FIG. 2 is an exploded-view of the electrical terminal connection system of FIG. 1A in accordance with one embodiment.

FIG. 2 is an exploded view of the connection system 10 of FIGS. 1A-1D. The connection system 10 includes a first-housing 12 having a first-electrical-terminal 14 and a terminal-hood 16. The first-housing 12 may be formed of a polymeric material having dielectric properties. The first-electrical-terminal 14 is formed of a conductive material, such as a copper-based alloy and may include a conductive coating, such as a silver-based alloy. The first-electrical-terminal 14 has a first-planar-section 18 having a rectangular cross-section. The terminal-hood 16 encapsulates an inner-surface 20 and edges 22 of the first-electrical-terminal 14 and may be formed of a dielectric material 24 to protect against an electrical shock, should a human finger contact the components disposed within the first-housing 12.

The connection system 10 also includes a second-housing 26 configured to mate with the first-housing 12. The second-housing 26 may be formed of a polymeric material having dielectric properties. The second-housing 26 includes a second-electrical-terminal 28 and a sliding-block 30. The second-electrical-terminal 28 is formed of a conductive material, such as a copper-based alloy and may include a conductive coating, such as a silver-based alloy. The second-electrical-terminal 28 has a second-planar-section 32 having a rectangular cross-section and overlays an outer-surface 34 of the first-electrical-terminal 14. In the non-limiting example illustrated in FIGS. 1A-2, the first-electrical-terminal 14 and the second-electrical-terminal 28 are orientated perpendicularly to one another.

The sliding-block 30 may define a guide-hole 36 aligned along a longitudinal-axis 38 of the sliding-block 30 and parallel to a mating-axis 40 (See FIG. 1D) of the connection system 10. The sliding-block 30 may also define a shoulder 42 that may be aligned orthogonal to the longitudinal-axis 38. The sliding-block 30 may be formed of a polymeric material having dielectric properties, or may be formed of a metallic material that may also perform the function of a heat-sink to conduct heat away from the connection system 10. The sliding-block 30 may be characterized as having a wedge-shape 44 (See FIG. 3), or may be characterized as having a conical-shape (not shown).

The second-housing 26 also includes a first-fastener element 48 operable to engage a second-fastener element 50 (See FIG. 3) disposed within the first-housing 12. Alternatively, the second-fastener element 50 may be integrated into a mounting-bracket separate from the connection system 10. The first-fastener element 48 may include a flange 52 and a shank 54. The shank 54 may be positioned within the guide-hole 36 of the sliding-block 30 and the flange 52 may be in contact with the shoulder 42 of the sliding-block 30. The sliding-block 30 may also define a shoulder-projection (not shown) that engages the second-housing 26 when the first-fastener element 48 and the second-fastener element 50 are joined. The sliding-block 30 may be retained by the shank 54 to maintain a position within the second-housing 26, and to prevent the sliding-block 30 from loss during handling.

Figure 3:
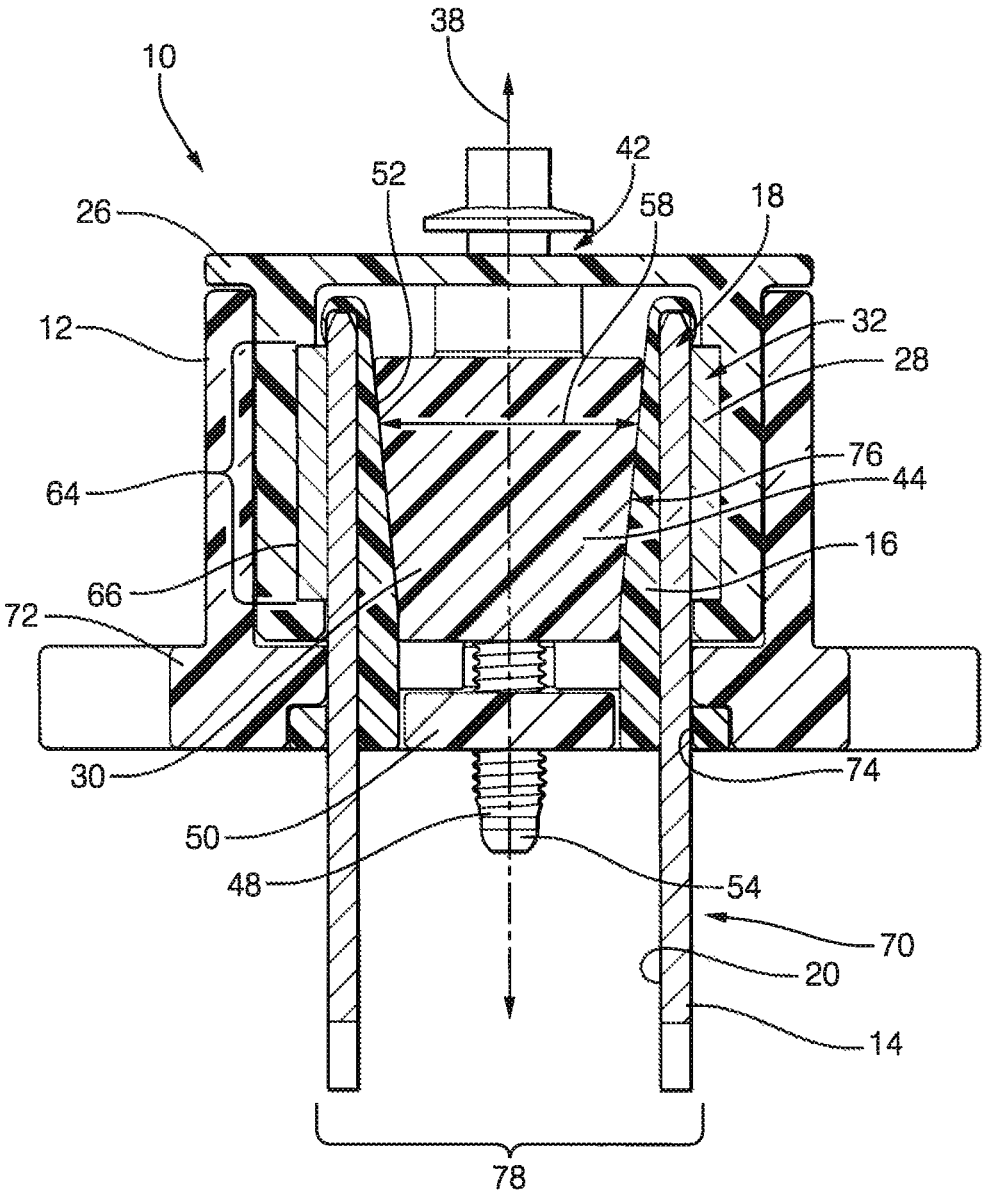
FIG. 3 is a cross-sectional view of the electrical terminal connection system of FIG. 1A in accordance with one embodiment.

FIG. 3 is a cross-sectional view of the connection system 10 and illustrates the first-housing 12 and the second-housing 26 in a mated-position, and illustrates the sliding-block 30 engaged with the terminal-hood 16. The second-housing 26 is drawn into the first-housing 12 when the first-fastener element 48 and the second-fastener element 50 are joined, whereby the sliding-block 30 imparts a lateral-force 58 on the terminal-hood 16 and urges the first-planar-section 18 of the first-electrical-terminal 14 into electrical-contact with the second-planar-section 32 of the second-electrical-terminal 28. Preferably, the lateral-force 58 is at least 30 Newtons (30 N) to achieve a reliable electrical connection that may withstand vibrational and thermal cycling inputs. Other methods of advancing the sliding-block 30 are contemplated, but not shown, and include, but are not limited to, a lever or a spring mechanism.

Figure 4A:
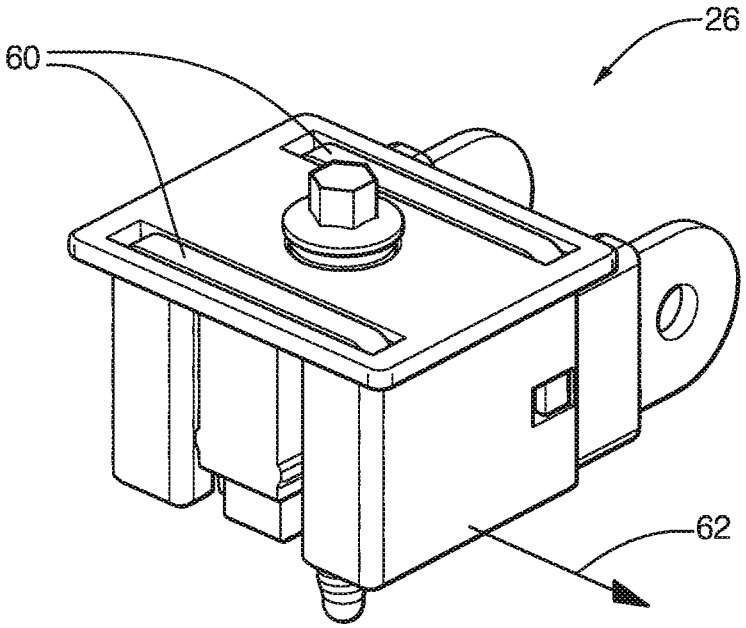
FIG. 4A is an illustration of a top-perspective-view of a second-housing of the electrical terminal connection system of FIG. 1A in accordance with one embodiment.
Figure 4B:
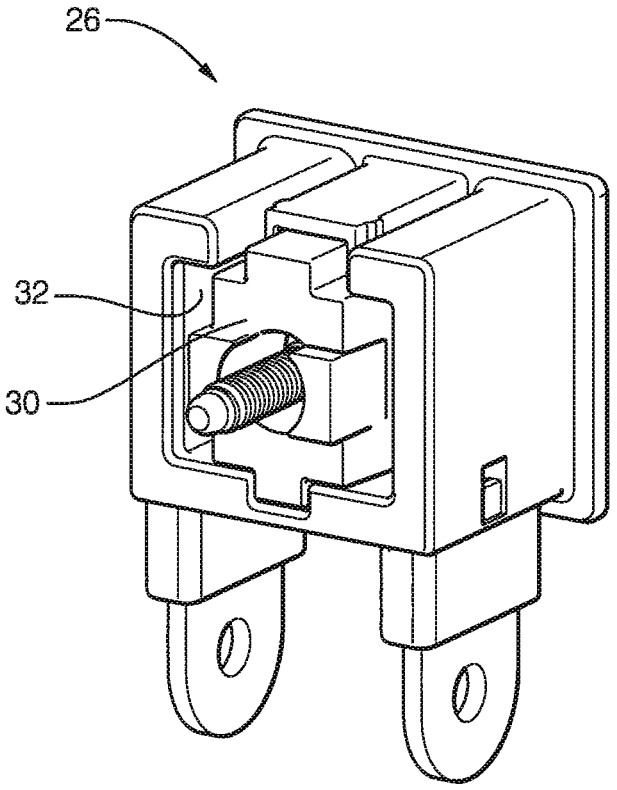
FIG. 4B is an illustration of a bottom-perspective-view of the second-housing of the electrical terminal connection system of FIG. 1A in accordance with one embodiment.

FIGS. 4A-4B illustrate the second-housing 26 isolated from the connection system 10. The second-housing 26 may include a retainer-clip 60 configured to inhibit a lateral-deflection 62 of the second-housing 26 when the sliding-block 30 imparts the lateral-force 58. The retainer-clip 60 may be formed of a metallic material, such as a steel-alloy, and may be dimensioned to counteract a portion or all of the lateral-force 58. The quantity and dimensions of retainer-clips 60 may be varied based on the geometry of the second-housing 26 and the magnitude of the lateral-force 58. The retainer-clip 60 may span a single pair of first-electrical-terminals 14 and second-electrical-terminals 28, or may span a plurality of pairs of first-electrical-terminals 14 and second-electrical-terminals 28. The retainer-clip 60 may also be a box-shaped component that may be connected to an electrical-ground to provide electrical-shielding to the connection-system 10.

The second-housing 26 may also include a blade-pocket 64 (see FIG. 3) that encapsulates an outer-surface of the second-electrical-terminal 66 and encapsulates edges of the second-electrical-terminal 68, as illustrated in FIGS. 2 and 3B. The clearance between the sliding-block 30 and the second-planar-section 32 of the second-electrical-terminal 28 is configured to prevent a human finger from contacting the second-planar-section 32 to protect against an electrical shock.

Figure 5:
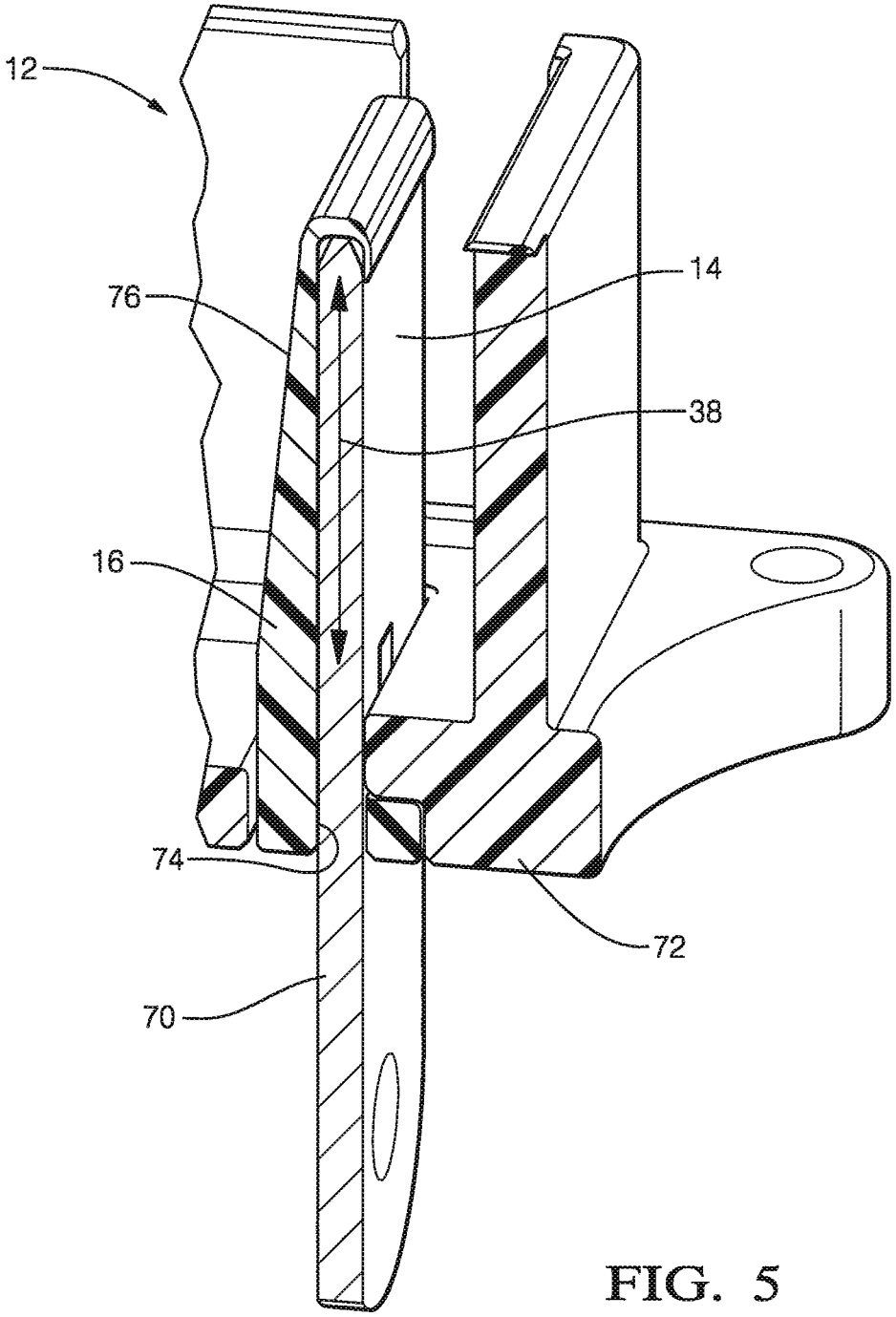
FIG. 5 is an illustration of cross-section of a first-housing of the electrical terminal connection system of FIG. 1A in accordance with one embodiment.

FIG. 5 illustrates a cross-section of the first-electrical-terminal 14 and terminal-hood 16 in the first-housing 12. An extension 70 of the first-electrical-terminal 14 may project beyond a base 72 of the first-housing 12. The terminal-hood 16 may further define an aperture 74 , wherein the extension 70 of the first-electrical-terminal 14 is disposed within the aperture 74 to prevent a movement of the terminal-hood 16. That is, the aperture 74 may inhibit the terminal-hood 16 from moving orthogonal to the longitudinal-axis 38 of the connection-system 10 by retaining the first-electrical-terminal 14. Movement along the longitudinal-axis 38 is also inhibited by an interference between the aperture 74 and the base 72 of the first-housing 12. The terminal-hood 16 may also include a ramp 76 that engages the sliding-block 30 and may couple with the wedge-shape 44 of the sliding-block 30 to further increase the lateral-force 58. The separate terminal-hood 16 component is beneficial compared to the terminal-hood 16 that is integral to the first-housing 12 because the separate terminal-hood 16 is able to travel with the first-electrical-terminal 14 as the first-electrical-terminal 14 deflects from the lateral-force 58. This travel reduces a bending strain that is characteristic of molded flexible beams.

The first-housing 12 may include a plurality of first-electrical-terminals 78 and the second-housing 26 may include a plurality of second-electrical-terminals 80, as illustrated in FIGS. 1-4. The plurality of first-electrical-terminals 78 and the plurality of second-electrical-terminals 80 may be positioned proximate to at least two opposing sides of the sliding-block 30, as illustrated in FIGS. 1-4. Other configurations are contemplated, but not shown, and include the plurality of first-electrical-terminals 78 and the plurality of second-electrical-terminals 80 positioned on one side of the sliding-block 30 that may be arranged in a linear and/or a non-linear pattern. The plurality of first-electrical-terminals 78 and the plurality of second-electrical-terminals 80 may also be positioned around a perimeter of a conical-sliding-block (not shown) and have a generally circular arrangement.

Accordingly, an electrical terminal connection system 10 (the connection system 10) is provided. The connection system 10 is an improvement over previous connection-systems because the connection system 10 allows an operator to assemble the connection system 10 with an insertion-force low enough to meet ergonomic limits for an assembly operator, and then, by joining the first-fastener element 48 with the second-fastener element 50, generate the lateral contact force of 30 newtons or more between the male and female terminals that enables the high current electrical connection of 100 amperes or more.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical terminal connection system, comprising:

a first-housing having a first-electrical-terminal and a terminal-hood, said first-electrical-terminal has a first-planar-section having a rectangular cross-section, said terminal-hood encapsulates an inner-surface and edges of the first-electrical-terminal; and a second-housing configured to mate with the first-housing, said second-housing having a second-electrical-terminal and a sliding-block, said second-electrical-terminal has a second-planar-section having a rectangular cross-section configured to overlay an outer-surface of the first-electrical-terminal, wherein the second-housing further comprises a first-fastener element operable to engage a second-fastener element disposed within the first-housing, wherein the second-housing is drawn into the first-housing when the first-fastener element and the second-fastener element are joined, whereby the sliding-block imparts a lateral-force on the terminal-hood and urges the first-planar-section into electrical-contact with the second-planar-section.

2. The electrical terminal connection system in accordance with claim 1, wherein the second-housing includes a retainer-clip configured to inhibit a lateral-deflection of the second-housing when the sliding-block imparts the lateral-force.

3. The electrical terminal connection system in accordance with claim 1, wherein the terminal-hood is composed of a dielectric material.

4. The electrical terminal connection system in accordance with claim 1, wherein an extension of the first-electrical-terminal projects beyond a base of the first-housing, said terminal-hood further defines an aperture, wherein the extension is disposed within the aperture thereby inhibiting a movement of the terminal-hood.

5. The electrical terminal connection system in accordance with claim 1, wherein the terminal-hood includes a ramp that engages the sliding-block when the first-housing is mated with the second-housing.

6. The electrical terminal connection system in accordance with claim 1, wherein the second-housing includes a blade-pocket that encapsulates an outer-surface of the second-electrical-terminal and encapsulates edges of the second-electrical-terminal.

7. The electrical terminal connection system in accordance with claim 1, wherein the lateral-force is at least 30 Newtons.

8. The electrical terminal connection system in accordance with claim 1, wherein the first-electrical-terminal and the second-electrical-terminal are orientated perpendicularly to one another.

9. The electrical terminal connection system in accordance with claim 1, wherein the sliding-block is characterized as having a wedge-shape.

10. The electrical terminal connection system in accordance with claim 1, wherein the sliding-block is characterized as having a conical-shape.

11. The electrical terminal connection system in accordance with claim 1, wherein the first-housing includes a plurality of first-electrical-terminals and the second-housing includes a plurality of second-electrical-terminals.

12. The electrical terminal connection system in accordance with claim 11, wherein the plurality of first-electrical-terminals and the plurality of second-electrical-terminals are positioned proximate to at least two opposing sides of the sliding-block.

13. The electrical terminal connection system in accordance with claim 11, wherein the plurality of first-electrical-terminals and the plurality of second-electrical-terminals are positioned on one side of the sliding-block.

14. The electrical terminal connection system in accordance with claim 1, wherein the first-fastener element further includes a flange and a shank, and wherein the sliding-block defines a guide-hole and a shoulder, wherein the shank is positioned within the guide-hole and the flange is in contact with the shoulder.

15. The electrical terminal connection system in accordance with claim 14, wherein the sliding-block defines a shoulder-projection that engages the second-housing when the first-fastener element and the second-fastener element are joined.

* * * * *